US005504396A

United States Patent [19]

Fowers

[11] Patent Number: 5,504,396

[45] Date of Patent: Apr. 2, 1996

[54] DISCHARGE LAMP CONTROL SYSTEM

[76] Inventor: Michael B. Fowers, 26943 Lakewood Way, Hayward, Calif. 94544

[21] Appl. No.: 387,180

[22] Filed: Feb. 13, 1995

[51] Int. Cl.[6] ..... H05B 37/00

[52] U.S. Cl. ..... 315/121; 315/128; 315/185 S; 315/320; 315/361

[58] Field of Search ..... 315/91, 121, 128, 315/320, 95, 361, 93, 123, 185 S

[56] References Cited

U.S. PATENT DOCUMENTS

| | | | |
|---|---|---|---|
| 304,884 | 9/1984 | Weston | 315/123 |
| 1,024,495 | 4/1912 | Booth | 315/123 |
| 4,066,931 | 6/1978 | Morrill | 315/241 R |
| 5,397,963 | 3/1995 | Manson | 315/121 |

OTHER PUBLICATIONS

Miller, Neon Techniques & Handling, 1988 pp. 209–211.
Miller, Neon Techniques & Handling, 1988 pp. 211–214.

*Primary Examiner*—Robert J. Pascal
*Assistant Examiner*—Reginald A. Ratliff

[57] ABSTRACT

A new method of control of high voltage gaseous conductor lamps is herein provided allowing the selective control of the operation of such lamps in a single, or multiple lamp series-connected, current regulated supply circuit, through selective shorting of said lamps with semiconductor devices. The method provided herein also allows selective operation of an infinite number of lamps on a single supply circuit.

22 Claims, 3 Drawing Sheets

DISCHARGE LAMP CONTROL SYSTEM

BACKGROUND OF THE INVENTION

This invention relates to high voltage gaseous conductor discharge lamp control apparatus— specifically a new method of controlling the functioning of such lamps through selective electric shorting using semiconductor devices.

BACKGROUND OF THE INVENTION—PRIOR ART

Until now, the only ways to control the lighting of individual high voltage low current gaseous conductor lamps, such as are commonly known in the sign industry as neon lamps, was either to use a separate transformer for each stage and control the primary power to each transformer, or to use mechanical distribution devices in the high voltage secondary circuit.

A mechanical "point contact" transformer primary controller is shown and described by Miller in the 1988 printing of "Neon Techniques & Handling" pp 209–211. In using a separate transformer for each lamp, acceptable long-lasting control can be achieved, but the cost of the individual transformers makes only large displays practical. A less expensive method can be had with mechanical distribution devices which use a motor-driven rotating armature and suitable high voltage contacts inside an insulative housing to physically move the high voltage electric power of the secondary of the transformer between contacts as is shown ,and described by Miller again in the 1988 printing of "Neon Techniques & Handling" pp 211–214. These devices are similar to automobile distributors. Inherent in this method, however, is internal arcing on the contacts of the device, and the devices are typically short-lived, soon require servicing, and as with most mechanical devices, a desire to change the control sequence means manufacturing a different controller.

U.S. Pat. No. 4,066,931 issued to Morrill on Jan. 3, 1978 describes a modulator circuit for a high current, low voltage xenon lamp with third "starting" electrode. This circuit is specific to the purpose of modulation however, and could not operate a plurality of lamps due to it's series switch and inductor. A simple "on or off" signal to the shunt transistor will not result in the lamp producing light because this circuit's use of a semiconductor shunt is not selective, but rather the shunt must be "pulsed" in coordination with the series switch to start the lamp as described. This circuit is also not a practical system of switching for one or more discharge lamps which use a current limiting power source, but is itself a current limiting and voltage controlling modification system for a single lamp.

As is well known with discharge lamps used in neon signs etc., these lamps require current limiting after the voltage breakdown potential is reached, the gas ionizes, a current avalanche is initiated, and the resistance drops. Almost universally employed for this type of lighting is the shunt-reactance transformer which provides one or more alternate paths of magnetic flux conduction in the core of the transformer, usually through an air gap to provide pre-set current limiting operation. This transformer automatically varies the voltage across the load—whatever the load is, to keep the current at a designed value. This type of transformer can actually have it's output terminals shorted without harm, despite it's high-voltage output, and is typically rated at this short-circuit value. The short-circuit current level for typical discharge lamps is 10 to 120 milliamperes, with 30 milliamperes being almost universally standard, and operating voltage outputs of 2,000 to 15,000 VAC. Used also with increasing popularity are high voltage, high-frequency discharge lamp power supplies. These devices operate on the principle that a higher frequency yields a supply with a smaller transformer. They incorporate frequency generating, control, and power transformation electronics in a compact and light weight package. In either power delivery system, the end result is high voltage current controlled delivery of power meeting the requirements of the discharge lamp.

Because of this relatively low, automatic, current limited operating requirement of the discharge lamp, a new method of control may be advantageously employed using selective shorting of one or more discharge lamp units with semiconductor technology to yield control of a vast number of series-connected lamps on as little as one supply circuit.

It should be noted here that previous descriptions specify, as an example only, the typical shunt reactance transformer and high-frequency power supplies currently used with typical discharge lamps. This new method of control of discharge lamps should not be limited, however, to a specific transformer or power supply type, as it can be employed in any electric delivery system which is capable of operating discharge lighting.

OBJECTS AND ADVANTAGES

1) A new method of control of high voltage gaseous conductor discharge lamp operation.

2) The ability to control many discharge lamps on as few as one supply circuit.

3) A reliable and long-lasting method of discharge lamp control.

4) The ability to use a single supply circuit to it's fullest potential thereby gaining a significant cost effective savings advantage.

5) The ability to operate an infinite number of lamps on a supply capable of operating as little as one lamp.

6) A control system which is easily added into common and/or existing discharge lighting power systems.

7) A control system in which the control sequences are easily changed.

LIST OF REFERENCE NUMERALS

10—Opto-triac
20—Gaseous conductor discharge lamp
30—Shunt reactance transformer
40—SPST switch
50—Common battery
60—Control circuit
65—Zero crossing detector
70—Capacitor
80—Resistor
90—Triac
100—Control circuit with oscillating control outputs
110—Triac trigger transformer
120—Lag network resistor
130—High-frequency power supply
140—Diode bridge
150—Opto-transistor

DETAILED DESCRIPTION AND BEST MODE OF OPERATION

The present invention advantageously provides discharge lamp lighting control over any practical number of discharge lamps through selective semiconductor shorting of desired lamps as follows.

Figure 1:
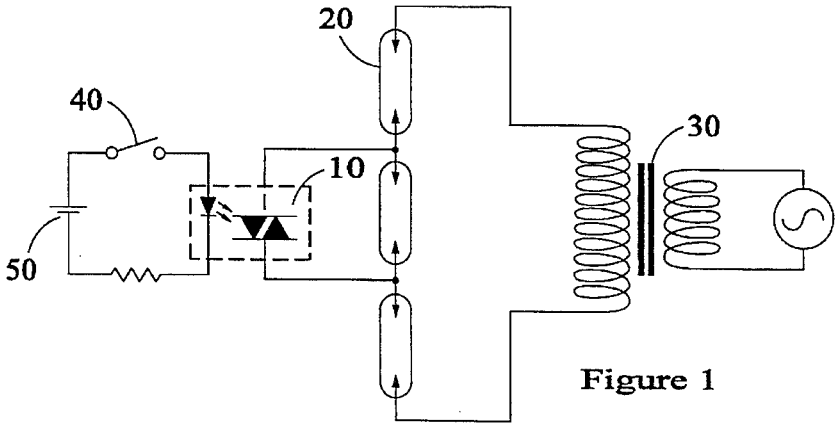
FIG. 1 shows the simplest implementation of the present invention with a common battery, resistor, and switch, which provide selective L.E.D. current for the opto-triac, which then shorts it's associated discharge lamp when the switch is closed.

FIG. 1 shows the simplest implementation of the present invention. Series connected discharge lamps 20 are connected to a common shunt-reactance transformer 30, which is the typical power supplying source for high voltage low current lamps. This type of transformer tailors it's output's operating characteristics to match the requirements of gaseous conductor lamps by providing a voltage high enough to initiate voltage breakdown and subsequent conduction of said lamps while providing the automatic voltage reduction and current limiting required for practical operation of such lamps. With switch 40 open, no current flows to the internal L.E.D. of opto-triac 10, and lamps 20 operate normally. When switch 40 is closed, battery 50 provides current to the internal L.E.D. of opto-triac 10 which changes the lamp terminals of opto-triac 10 from a high resistance state to a low resistance state which then provides an alternate path of current for it's associated lamp 20. As long as power is supplied to the internal L.E.D. of opto-triac 10, this lamp never reaches the voltage necessary to initiate breakdown, conduction, and the subsequent production of light. With the lamps arranged in series, as shown, the other lamps 20 remain lit and their light production function is unaffected by the state of the controlled lamp.

Generally with all triggerable semiconductor devices used in the methods presented in accordance with the present invention, a trigger voltage is required which is relative to a device terminal which is connected to a lamp. Thus to trigger the device, a voltage must be employed which is at the same voltage as the desired lamp at the time of triggering, plus enough additional voltage required to trigger the device. Peculiar to the present invention is that this required trigger voltage may be anywhere from zero to thousands of volts. And this value varies depending on when in the alternating current cycle the device is triggered. Obviously, one could monitor the alternating current line voltage and switch the devices at the zero crossing, but this is not always foolproof and, at present, the best method of solving this triggering requirement is by using optoelectronic devices. These devices provide level translated triggering, and allow convenient low voltage triggering for standard control methods such as computer logic levels. However, as will be shown, optoelectronic devices are only one of a myriad of devices that could be employed for discharge lamp control in accordance with the present invention.

Figure 2:
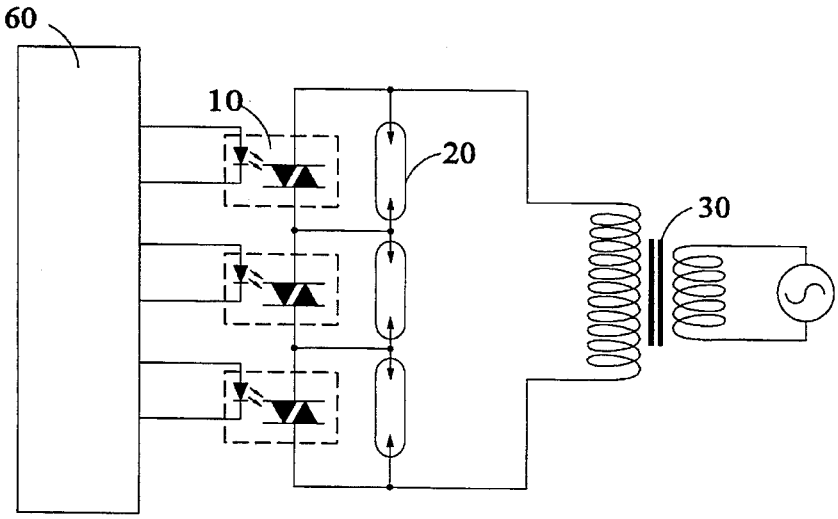
FIG. 2 shows the present invention implemented with a programmed control circuit controlling several lamps on a single supply circuit.

FIG. 2 shows the present invention implemented with a more practical control circuit 60 which provides selective power to the internal L.E.D.'s of opto triacs 10 and controls lamps 20 in the same functional manner as that of FIG. 1. This control circuit is most conveniently in the form of a computer system in which a timed pattern of control signals is generated. In this manner, the timing and particular patterns are easily changed through common storage methods such as an EPROM or floppy disk. In this embodiment it may also be seen how an infinite number of lamps can be operated on a supply which is not capable of operating all of the lamps in series. If shunt-reactance transformer 30 is capable of illuminating only one of lamps 20, control circuit 60 then simply controls opto-triacs 10 to illuminate one lamp at a particular time. In this manner, an infinite number of lamps can be operated on one supply circuit, while in fact, this circuit is actually capable of illuminating only the maximum number of lamps that are desired to be on at one time, providing a tremendous cost savings over conventional methods for this example application.

Figure 3:
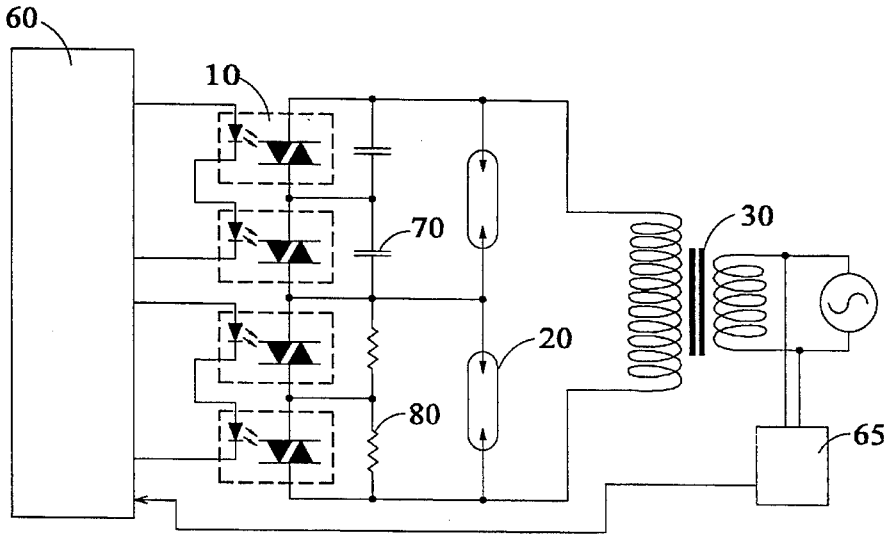
FIG. 3 shows how the present invention may be used with lamps of higher breakdown voltage than would be possible with one lamp control device.

FIG. 3 shows the preferred embodiment of the present invention. As with all semiconductor devices, the terminals of triacs and opto-triacs which provide the variance in resistance function have a limit to the amount of voltage that can be applied without malfunction. If this limit is exceeded, the device may short, open, and/or destroy itself. This embodiment of the present invention allows lamps of higher starting potential than is possible with a single or opto-triac due to the individual device's maximum voltage breakdown rating to be used. Multiple opto-triacs 10 connected in series and operated together as shown, provide effectively a single device with a main terminal maximum working voltage breakdown rating equal to the additive total of the individual opto-triacs used. In this manner, a lamp of starting potential just less than the breakdown potential of the total number of opto-triacs may be employed. Series connected opto-triacs 10 may be triggered in the same manner as previously explained and are triggered here by the same control circuit 60 used in the previous embodiment. As with many series connected semiconductors used as described herein, tolerances in devices may produce operational charge distribution differences which create an unequal split of voltage across the operating terminals of the series connected devices used when the devices are in their high resistance states. Capacitors 70 are used to keep the particular lamp 20 portion of voltage from transformer 30 equal across each semiconductor device. However this only necessary when particular manufacturing tolerances require it. Also illustrated are resistors 80 which result in exactly the same function as capacitors 70 but because of breakdown ratings and prices, are generally less practical. Additionally, because different batches of devices may have slightly different triggering points it is sometimes desirable to simply trigger selected devices when voltage is at zero. This is easily accomplished with voltage monitor 65 which provides a signal to control circuit 60 upon zero crossing. Control circuit 60 then changes control signals at zero voltage points via signal from monitor 65. While one could devise a monitor which looks at the high voltage side of the transformer, but in practice it has been found to be unnecessary and of higher expense than the primary side monitor.

It should be noted that all control circuits are simply used to selectively apply trigger power to the lamp control sections. Obviously, to persons skilled in the art, many circuits can be devised to meet this requirement and it is not essential to operation of the present invention by which means control is had. The only requirement of the control system is that it performs the desired control function and that it provides a required signal to the lamp control devices or circuitry. Present technology exists to an extent that the control circuit could possibly be anything from a manually operated switch to a computer control system. And depending upon the user, either might be acceptable.

It is hoped that it may now be seen that many variations of the present invention are possible to those skilled in the art. The amount of semiconductor devices available today, and methods of employment of them in accordance with the present invention are many, and new devices are devised regularly. Due to the these facts, the descriptions given herein the present application are provided to illustrate the present best modes of implementation only. It is not the purpose of any description herein to limit the present invention to any specific semiconductor device or combination of devices, but to show how any semiconductor device or combination of devices which meet the required criteria of operation and are constructed in accordance with the present invention, can be utilized to achieve control of discharge lamp operation.

Figure 4:
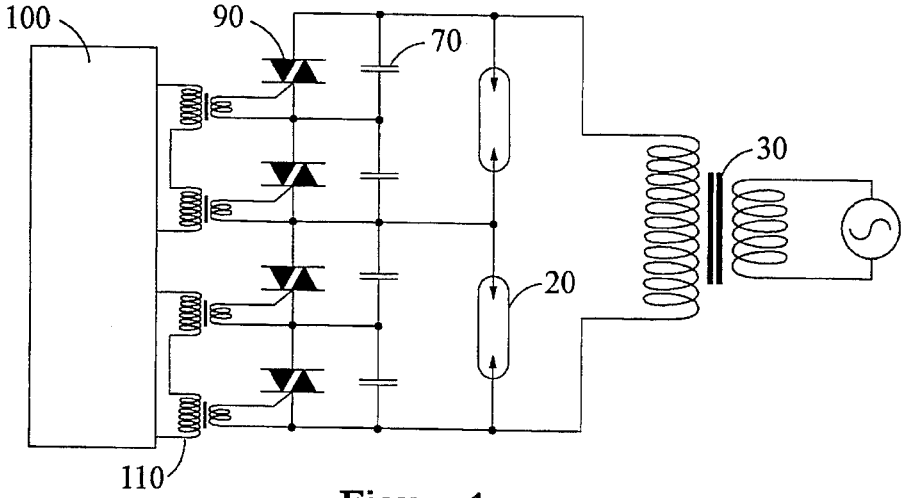
FIG. 4 shows the present invention implemented with triacs as the lamp control element with transformers providing level translation and triggering power.

FIG. 4 shows another embodiment of the present invention which illustrates how the present invention is implemented with a different lamp control device which requires different triggering circuitry. In this embodiment of the present invention, the control circuit 100 is different from previous embodiments only in that it provides selective oscillating trigger power necessary to power transformers 110 which trigger triacs 90. Transformers 110 provide the level translation, isolation, and relative triggering voltage required to operate a common triac as explained previously.

Figure 5:
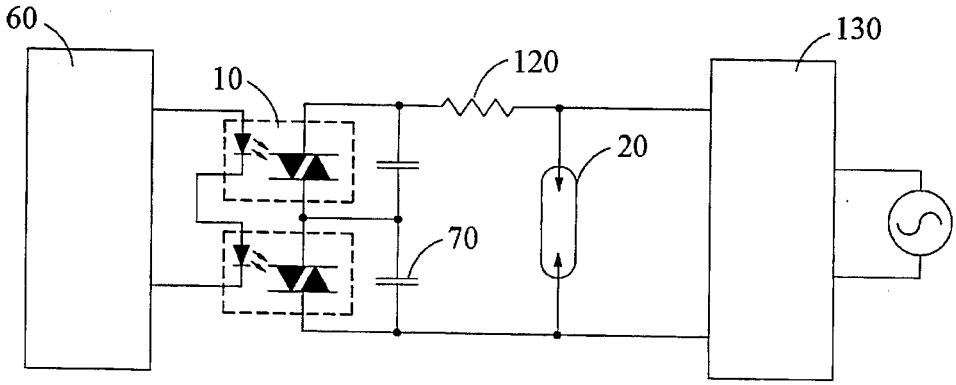
FIG. 5 shows how the present invention is implemented for use with a high frequency power source with the resistor and capacitors comprising a lag network which eliminates false triggering.

Universally employed in discharge fight production for over 70 years, the shunt reactance transformer, until recently, was the only commercial method of powering discharge lamps. Recently there has been development of compact, fight weight, high frequency power supplies for discharge lamps and FIG. 5 shows how the present invention is easily implemented with the new type of high frequency power supplies. These supplies operate discharge lamps at a higher frequency than the typical 60 HZ shunt-reactance transformer. Incorporating frequency generating, control, and power transformation electronics in a lightweight package, these supplies apply the common electronic principle that a higher frequency means a smaller transformer, typically operate at frequencies just beyond human heating, and generally include a ballast reactance to limit current.

As with typical triacs, opto-triacs, and other 4-layer or triggerable semiconductor devices, a rate of rise of voltage across the variable resistance terminals of the devices exists such that after a critical value, the device may falsely trigger into it's on state. This is the value typically known as the maximum DV/DT. Some new high frequency power supplies exceed this rate of rise specification for some semiconductor devices used in accordance with the present invention, nevertheless the present invention is easily implemented with only the slightest modification. FIG. 5 shows how a power source 130 of a frequency greater than the particular device's critical rise rate is used in accordance with the present invention. The addition of resistor 120 of proper value in conjunction with capacitors 70 forms a high frequency lag network which reduces high frequency voltage from high frequency supply 130 at standard opto-triac 10 terminals but not at lamp 20 itself, thus eliminating false triggering of the device used, while allowing full functionality in accordance with the present invention. Any control circuitry fulfilling the requirements of the particular device used may be employed. Standard controller 60 is used in this illustration, as it is suited to opto-triacs 10, however, this method will also work with other devices which suffer from this rate of rise false triggering problem such as standard triacs 90 in the circuit of FIG. 4.

It may now be readily apparent to anyone skilled in the art that the method of the present invention is to provide a selective current path for the current provided from the power supply to the discharge lamp thereby selectively inhibiting desired discharge lamp operation with semiconductor technology. The embodiments shown herein are merely the most practical with current technology. Obviously many devices may be devised to accomplish this task, and many triggering methods may also be employed. Analysis will reveal, however, that any circuit must include the basic elements as provided herein to accomplish the task of control in accordance with the present invention.

Figure 6:
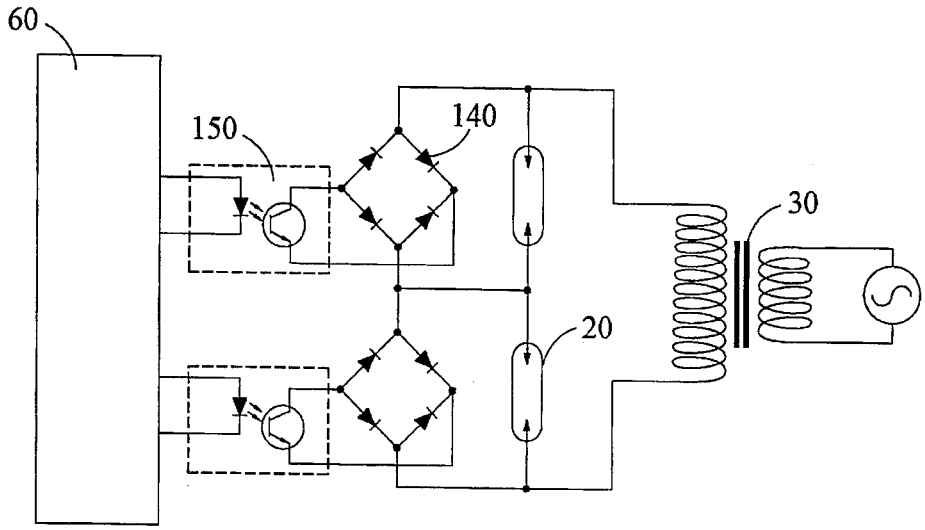
FIG. 6 shows how the present invention is implemented with unidirectional lamp control elements by routing bidirectional current through a diode bridge.

FIG. 6 shows how the present invention may be implemented using a unidirectional semiconductor device as the control element. In this embodiment, diodes 140 are employed to direct the alternating current unidirectionally into opto-transistor 150. Selective power to the internal L.E.D. of opto-transistor 150 then provides a selective alternating current path through diodes 140 and opto-transistor 150, providing the identical control outcome as with all of the embodiments of the present invention previously shown. Additionally, in a similar manner previously shown using triacs, regular transistors could easily be employed using a transformer triggering scheme.

Figure 7:
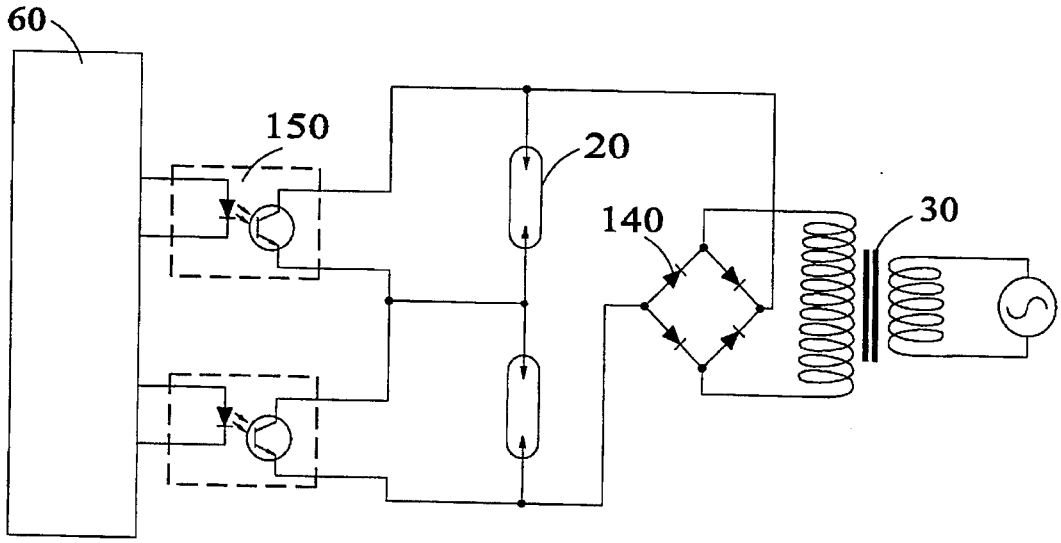
FIG. 7 shows how the present invention is implemented with a unidirectional power source.

While the previous embodiments employ the most cost effective commercial implementations of the present invention due to the fewest and simplest parts, in certain scientific endeavors it may be desirable to gain control of high voltage discharge lamps using a unidirectional power source. FIG. 7 shows how the present invention may be implemented using a unidirectional semiconductor device with a unidirectional high voltage current source. In this embodiment, the same diodes 140 and shunt-reactance transformer 30 of previous embodiments are combined to form a simple high voltage, current limiting, unidirectional power supply, consolidating the rectifiers of FIG. 6 in a central area and allowing control of lamps 20 with opto-transistors 150 in accordance with the present invention. Obviously this power supply could be made more regulatory and one could even substitute bidirectional semiconductor devices with the same results. The present embodiment shown here is the simplest form to show to illustrate how it may be used with the present invention. Just as with previous embodiments, one could series connect several opto-transistors together to provide switches with higher breakdown potential, or use regular transistors with transformer triggering and so on.

SUMMARY, RAMIFICATIONS, & SCOPE

It can now be seen bow the elements of the present invention as set forth herein, advantageously provide control of light production of one or more discharge lamps by providing a selective shunt path for current at the terminals of said lamps using a wide variety of semiconductor devices. Requisite to these devices, a variety of triggering and control methods have been provided to illustrate the method and versatility of the present invention. Additionally, this method features:

inexpensive, reliable, and long-lasting control.

the ability to light more lamps than a particular power supply is able.

display weight reduction due to fewer transformer supplies.

easily changeable lamp sequence control.

Although the previous description contains many specifics, these should not be construed as limiting to the scope of the invention, but merely as illustrations of the many preferred embodiments of the present invention. A vast number of both control and triggering schemes may be employed in accordance with the present invention, and in a variety of applications, any might be desired. Thus the scope of the invention should be determined by the appended claims and their legal equivalents, rather than by the examples given.

I claim:

1. Circuitry for selectively illuminating at least one high-voltage gaseous conductor lamp of a plurality of said lamps connected in series, said circuitry comprising:

at least one current limiting high voltage power source coupled across the plurality of gaseous conductor lamps, said power source producing power capable of illuminating at least one of said lamps;

a lamp control circuit having a plurality of output conductors, said control circuit being capable of applying an output signal to selected conductors of said output conductors; and one or more switches comprised of conducting and semiconducting materials connected in parallel with one or more associated said gaseous conductor lamps, said switches coupled to one or more of said output conductors and responsive to an output signal therefrom for deactivating selected switches to illuminate associated lamps.

2. The circuitry claimed in claim 1 wherein the high voltage current limiting power source includes a shunt-reactance transformer.

3. The circuitry claimed in claim 2 wherein said switches are opto-triacs, at least one of said opto-triacs coupled to short-circuit at least one high voltage gaseous conductor lamp in said plurality.

4. The circuitry claimed in claim 3 wherein a said switch includes a plurality of opto-triacs connected in series.

5. The circuitry claimed in claims 4 wherein said plurality of switches is connected to an electric component network, said network constructed of components which, and interconnected in a manner whereby, an effective operational equity of distribution of voltage across each said switch in said plurality is achieved.

6. The circuitry claimed in claim 5 wherein said network comprises the shunting of each switch in said plurality by a capacitor.

7. The circuitry claimed in claim 2 wherein said switches are triacs, each being controlled by a transformer energized by an output signal from said control circuit, at least one of said triacs coupled to short-circuit at least one high voltage gaseous conductor lamp in said plurality.

8. The circuitry claimed in claim 6 wherein a said switch includes a plurality of triacs connected in series.

9. The circuitry claimed in claims 8 wherein said plurality of switches is connected to an electric component network, said network constructed of components which, and interconnected in a manner whereby, an effective operational equity of distribution of voltage across each said switch in said plurality is achieved.

10. The circuitry claimed in claim 1 wherein the high voltage current limiting power source produces power with frequency of alternation greater than 60 hertz.

11. The circuitry of claim 10 including a high frequency lag network interposed between at least one said lamp and at least one said switch.

12. The circuitry claimed in claim 2 wherein said switches are opto-transistors coupled across a diode bridge circuit, each said opto-transistor rendered conductive by said output signal from said control circuit, whereby the associated diode bridge circuit current flows in either direction around an associated high voltage discharge lamp upon conduction of said opto-transistor.

13. The circuitry claimed in claim 1 wherein the high voltage power source produces unidirectional current.

14. The circuitry claimed in claim 13 wherein said switches function unidirectionally.

15. The circuitry claimed in claim 14 wherein said switches are opto-transistors.

16. The circuitry claimed in claim 15 wherein a said switch includes a plurality opto-transistors.

17. The circuitry claimed in claims 16 wherein said plurality of switches is connected to an electric component network, said network constructed of components which, and interconnected in a manner whereby, an effective operational equity of distribution of voltage across each said switch in said plurality is achieved.

18. The circuitry claimed in claim 1 wherein said control circuit includes means for control by a human operator.

19. The circuitry claimed in claim 1 wherein said control circuit includes circuitry to apply output signals to said output conductors from a prearranged program.

20. The circuitry claimed in claim 1 wherein said control circuit changes said output signals to said output conductors when power to or from said power source is at a low state.

21. Circuitry for selectively illuminating a high voltage gaseous conductor lamp comprising:

a high voltage current limiting power source coupled across said gaseous conductor lamp;

a control circuit having one or more output conductors, said control circuit being capable of applying an output signal to selected conductors of said output conductors; and a switch comprised of conducting and semiconducting materials connected in parallel with said gaseous conductor lamp, said switch coupled to one or more of said output conductors and responsive to an output signal therefrom for deactivating said switch to illuminate said lamp.

22. The method for selectively switching "on" or "off" at least one high voltage gaseous conductor lamp in a series connected plurality of said lamps, said plurality of series connected lamps being supplied by a high voltage current limiting source capable of illuminating at least one of said lamps, said method comprising the steps of:

shunting at least one lamp of said plurality with a switch comprised of conducting and semiconducting materials;

providing a lamp control circuit coupled to each switch of said plurality for switching "on" and "off" selected switches in said plurality.

* * * * *